166-250 SR
10/21/80 OR 4,228,855

United States Patent [19]
Sustek, Jr. et al.

[11] 4,228,855
[45] Oct. 21, 1980

[54] METHOD OF INJECTIVITY PROFILE LOGGING FOR TWO PHASE FLOW

[75] Inventors: Alvin J. Sustek, Jr.; Terry L. Frazier, both of Houston; Gregory Daryl, Woodlands, all of Tex.

[73] Assignee: Texaco Inc., White Plains, N.Y.

[21] Appl. No.: 51,074

[22] Filed: Jun. 22, 1979

[51] Int. Cl.[2] ..... E21B 47/00; E21B 49/00
[52] U.S. Cl. ..... 166/250; 73/155
[58] Field of Search ..... 166/250, 252, 272, 303; 23/230.3; 73/155

[56] References Cited

U.S. PATENT DOCUMENTS

| | | | |
|---|---|---|---|
| 2,453,456 | 11/1948 | Piety | 166/250 UX |
| 2,524,933 | 10/1950 | Silverman | 166/250 |
| 2,700,734 | 1/1955 | Egan et al. | 166/252 X |
| 2,837,163 | 6/1958 | Ramos et al. | 166/250 |
| 2,869,642 | 1/1959 | McKay et al. | 166/250 |
| 2,947,869 | 8/1960 | Egan et al. | 73/155 X |
| 2,993,119 | 7/1961 | McKay | 73/155 X |
| 3,010,023 | 11/1961 | Egan et al. | 73/155 UX |
| 3,965,983 | 6/1976 | Watson | 166/250 |

*Primary Examiner*—Stephen J. Novosad
*Assistant Examiner*—George A. Suchfield
*Attorney, Agent, or Firm*—Carl G. Ries; Robert A. Kulason; Jack H. Park

[57] ABSTRACT

Fluid injectivity within an interval in a well bore is determined by injecting into the well two fluid streams, one of which flows down the tubing and one of which flows down the annulus, one of said fluid streams containing a radioactive tracer. The sum of the two fluid flow rates is held constant while each flow rate is varied against the other. At each different pair of flow rates, a stable interface is formed between the fluid containing the radioactive tracer and the fluid without it. The position of this stable interface at each different set of fluid flow rates is measured by a conventional gamma ray well logging tool, and from the series of such measurements an injectivity log over the measured interval can be determined. The injectivity profiles for the two components of a two phase fluid flow system are determined by conducting the survey with a radioactive tracer soluble in the gas phase and repeating the survey with a radioactive tracer soluble in the liquid phase.

11 Claims, 3 Drawing Figures

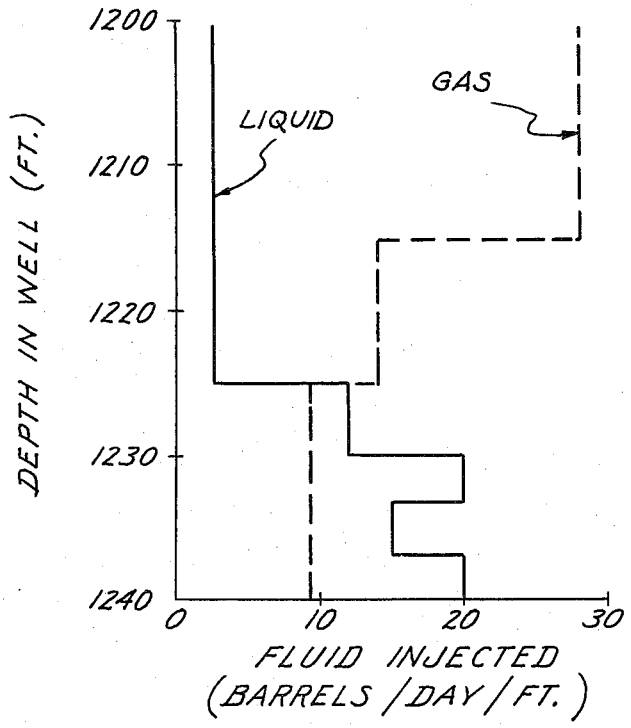
Fig. 2
Fig. 3
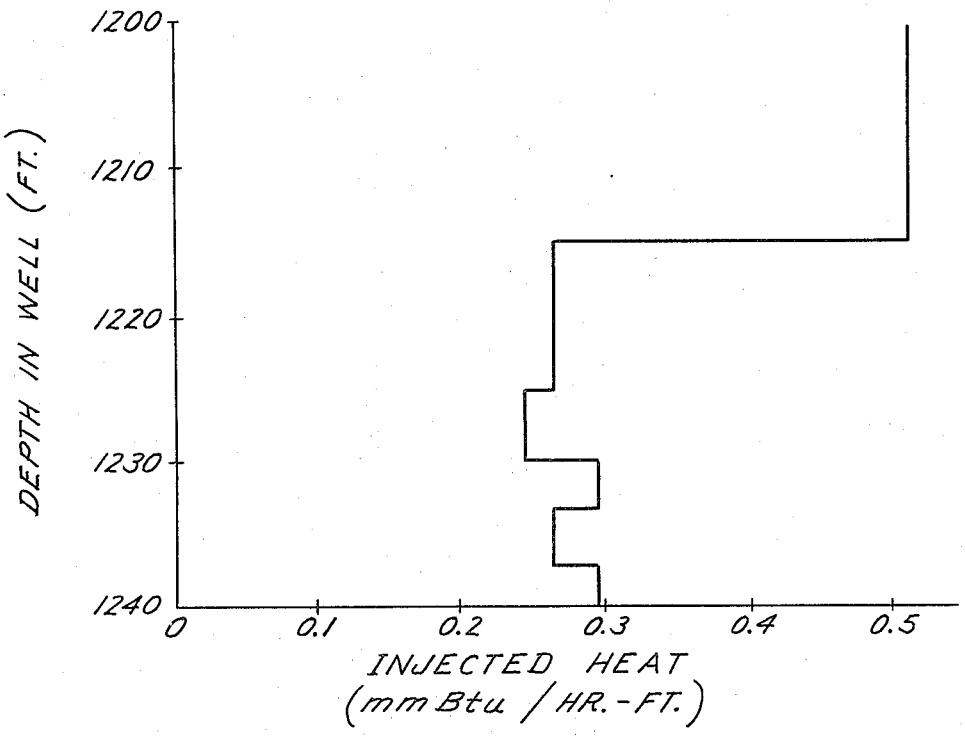

METHOD OF INJECTIVITY PROFILE LOGGING FOR TWO PHASE FLOW

FIELD OF THE INVENTION

This invention relates to a method for monitoring the injectivity of a two phase fluid along a well bore as it is injected into a subterranean formation through an injection well.

DESCRIPTION OF THE PRIOR ART

The injection of two phase fluids into subsurface earth formations has become increasingly wide spread in the last few years, particularly with regard to enhanced oil recovery projects. Unfortunately, this greatly increased use has not been accompanied by any significant increase in the knowledge of the behavior of different fluid phases within the well bore. Detailed information regarding the permeability of the zone along the well bore to each component of the two phase fluid is necessary in order to design an effective injection program. Knowledge of the injectivity of the gas and liquid phases over an interval of interest within the well bore provides important information necessary in many usages, among them are the design of above ground injection equipment and down hole maintenance projects such as perforating, fracturing and cementing as well as process performance analysis.

Two-phase fluids are often injected during the course of enhanced recovery operations. The injection of steam containing both water liquid and water vapor during the course of a steam flooding project is perhaps the most common. Mixtures of water liquid and air are often used in in situ combustion processes. Liquid hydrocarbons and carbon dioxide are often injected together in the course of a miscible flooding project. In a like manner, carbon dioxide can be mixed with water in certain recovery operations.

At the present time there exists no measuring process which can effectively and accurately describe the injectivity response for both phases of a two phase fluid as it is injected over an interval in the well bore. One method of obtaining an injectivity profile or permeability log for a one phase fluid in a particular formation traversed by a bore hole is described in U.S. Pat. No. 2,700,734 granted to Edmund F. Egan and Gerhard Herzog on Jan. 25, 1955. In this method, two streams of fluid are introduced into a well, one stream passing through a string of tubing extending downwardly to a point below the formation of interest and the other stream passing downwardly through the annular space through the tubing and the casing of the wall of the well. These streams are introduced or pumped into the well simultaneously and each stream is carefully metered at the surface. Fluid pumped down the tubing will, after filing the exposed portion of the well below the tubing, flow upwardly around the tubing until it meets the fluid flowing downwardly through the annular space, thus, forming an interface between the two streams or bodies of fluid. In order to locate the interface between the two streams, a small amount of tracer material, such as a radioactive substance, is added to one of the streams before it enters the well so that all of the fluid in this stream will be radioactive while the other stream will be nonradioactive. The depth in the well at which the interface lies may be readily located by lowering the detector, for example, a radiation detector, into the well and simultaneously and continuously recording the depth of the detector and the output signal therefrom. The response of the detector will change abruptly when the detector passes from the radioactive fluid into the nonradioactive fluid or vice versa.

By this method in order to determine the amount of fluid that is entering into a vertical increment of the formation of interest, the rates of injection of each of the two streams are varied but the sum of the rates is maintained constant. By changing the ratio of the amount of the radioactive fluid to the amount of nonradioactive fluid injected into the well the interface will be forced to move to another depth in the well. The difference in the amount of either of the fluids injected into the well is the amount of fluid that is entering the vertical increment of the formation between two interfaces. It can be seen that, by making appropriate changes in the ratio of the amount of radioactive fluid to the amount of nonradioactive fluid pumped into the well, the interface can be moved in a number of steps through the well past the formation of interest to provide an accurate log of the permeability of the formation. The length of each of the vertical increments between the successive interfaces depends upon the amount of change of the rates of the two streams and the permeability of the increment. After each adjustment or change in the rates of the two streams and after the interface between the two fluids has been stabilized, the rate of flow of the two streams is noted and the radiation detector passed through the well to determine the depth of the interface. Accordingly, it can be seen that in this manner an injectivity profile log is made of a formation which clearly shows the permeability of the various components of the formation.

However, the use of this invention is restricted to the measurement of a single fluid phase. The following U.S. Patents are similarly restricted and contain various improvements and refinements based upon the above referenced patent: U.S. Pat. Nos. 2,869,642, issued to McKay and Egan; 3,010,023, issued to Egan, Widmyer and McKay; 3,100,258, issued to tenBrink and Widmyer; and 3,105,900, issued to Widmyer. None of these patents however, indicate that their practice may be extended to a usage which involves the measurement of the injectivity of both phases of a two phase injected fluid system.

An accurate description of the different injectivities of each component in a two phase injected fluid system is an extremely important piece of information. In most, if not all cases involving the injection of a two phase fluid system the injection behavior of one phase is quite different from that of the other phase. It can be readily appreciated that, in a case such as an in situ combustion program comprising injection of both water liquid and air, the relative amount of each phase being injected at a given point in the well bore is of crucial importance to the success of the injection program. Since knowledge of the injectivity profiles of the two different phases is a critical parameter in the design of the injection program, such knowledge would be very useful in a steam injection program enabling the practitioner to formulate heat injectivity profiles over the interval of interest and thereby much more accurately describe the progress and expected results of the steam flood.

SUMMARY OF THE INVENTION

This invention discloses a method for making a permeability log for the injection of a two phase fluid into a subsurface formation traversed by a bore hole. The method comprises: first injecting a two phase fluid into the bore hole above the formation, the two phase fluid containing an effective amount of one radioactive substance which combines almost exclusively with only one phase of the injected two phase fluid; secondly, simultaneously injecting a similar two phase fluid which does not contain a radioactive substance into the well bore below the formation; thirdly, establishing a stable interface between the two fluids; fourth, determining the depth in the hole of said interface by measuring the radioactivity of the fluids throughout that portion of the hole being examined; fifth, varying the ratio of the rates at which the two fluids are injected into the hole while maintaining the sum of the two rates as nearly constant as possible so as to cause said interface to move along the walls of the bore hole to another depth; sixth, determining the depth of the interface produced by the change of injection rates in the preceding step by the method of the fourth; seventh, repeating the fifth and sixth steps until a series of depth and injection rate measurements obtained at the various interfaces sufficient to adequately describe the formation is obtained for one phase of the injected two phase fluid; and lastly, repeating steps one through seven, with a second radioactive substance which combines almost exclusively with the other phase of the two phase fluid.

BRIEF DESCRIPTION OF THE DRAWINGS

FIG. 2 is a graph showing the flow rates per foot of the two phases as a function of the depth in the well.

FIG. 3 is a graph showing the total heat injected as a function of depth in the well.

DESCRIPTION OF THE PREFERRED EMBODIMENTS

Figure 1:
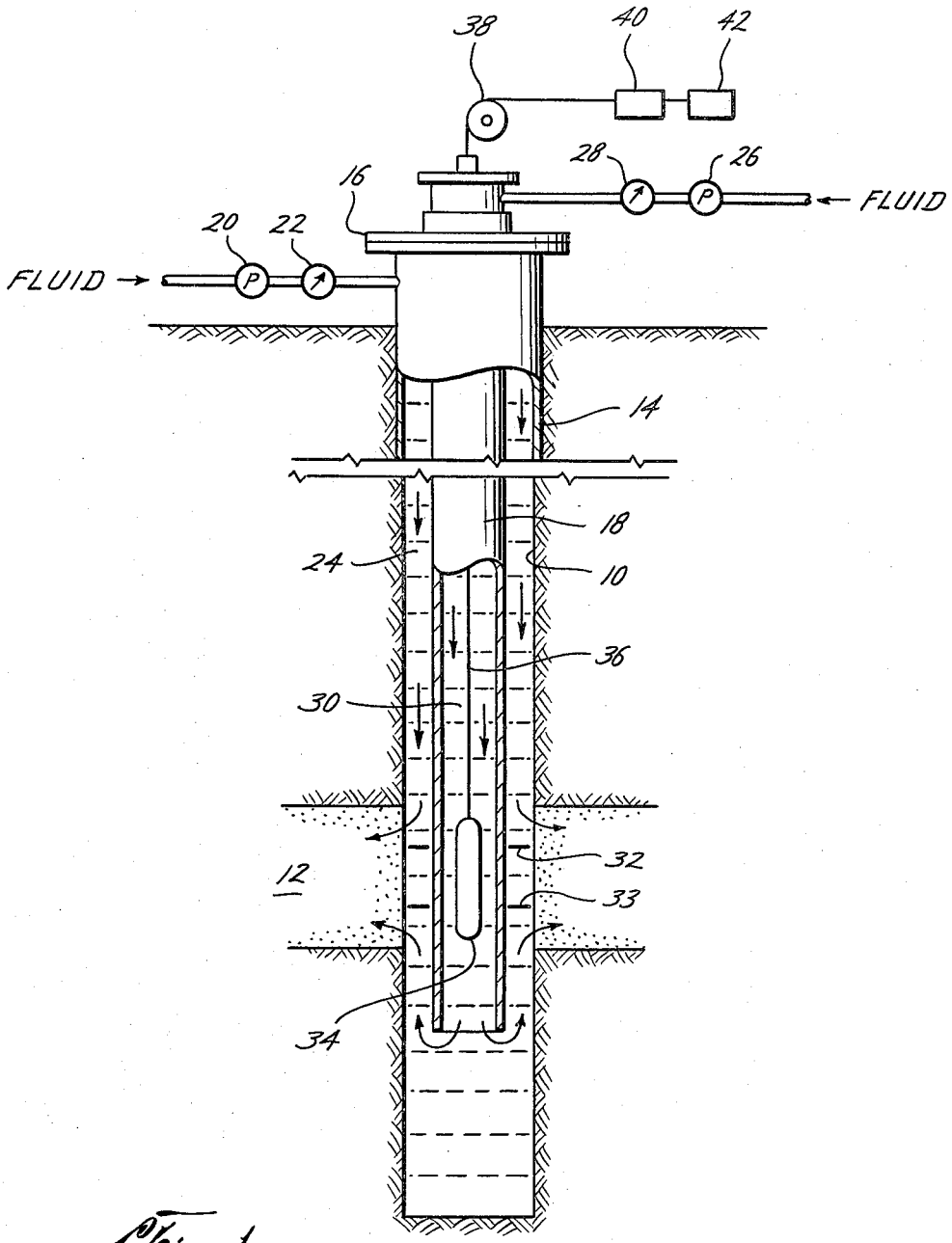
FIG. 1 is a vertical sectional elevation through a well showing the apparatus necessary for making an injectivity profile for one embodiment of the invention.

Although use may be made of this invention in generation of an injectivity profile for the injection of any two phase fluid, its practice will now be discussed in detail as it relates to the making of an injection profile for a formation undergoing steam injection. Two streams of the steam fluid are pumped into the well, one stream being injected through a string of tubing extending downwardly below the formation and the other being injected downwardly through the annular space between the tubing and the casing or the walls of the hole. The streams are injected simultaneously but separately, and each stream is carefully metered to provide steam quality and mass flow rate information. The steam pumped down through the tubing will emerge at a point below the formation of interest and flow upwardly around the outside of the tubing until it meets the steam pumped downwardly around the outside of the tubing in the annulus. An interface will form at the region in the annulus where the two streams or bodies of fluid meet.

Small amounts of a radioactive substance are then added to the steam being pumped down the annulus, the radioactive substance being of such a nature as to cause it to combine almost exclusively with the gaseous phase in the steam. As a result all of the steam that is pumped down the annulus is radioactive while the steam pumped down through the tubing is nonradioactive. In order to locate the interface between the radioactive steam and the nonradioactive steam, a radioactivity detector is passed through the tubing, its depth being recorded continuously. From the record of the output of the detector, the depth of the interface can be ascertained since the response of the detector will change more or less suddenly while the detector passes from the radioactive steam into the nonradioactive steam or vice versa.

In another preferred embodiment, the radioactive matter added to the fluid injected into the annulus is not introduced continuously but in small slugs. The radioactivity detector is positioned within the tubing slightly above the expected position of the interface. Once the response from the detector indicates that the slug of radioactive material in the annulus has passed by the detector, the detector is then lowered further into the casing to detect and record the exact position of the interface. This embodiment has the advantage of requiring smaller amounts of radioactive material.

The rates of injection of the two fluid streams can be varied by means of the pumps at the surface. The rates are adjusted that so at at all times the sum of the rates remains constant. One preferred method for controlling the rates is to utilize a single fluid source and divide its output between the tubing and the annulus. Another preferred control method is to utilize two separate fluid sources. By increasing the ratio of the amount of the radioactive steam injected to the amount of nonradioactive steam injected the interface will be forced downwardly through the well past the exposed walls of the formation or zone to be examined. As the rates of injection of the two fluid streams are varied by increments, the interface will move downwardly by steps. The vertical length of such steps will depend upon the permeability of the formation to the gaseous phase. After each change in the rates of injection for the two different fluid streams, the radiation detector is passed through the well and a record is made of the depth of the interface after each such change. In this manner, an injectivity profile for the gaseous phase of the steam is made of the formation of interest. This record will show clearly variations in the permeability of all the sections or portions of the formation in relation to the injection of the gas phase thereinto.

In a similar manner an injectivity profile for the liquid phase contained within the steam is made of the formation by utilizing a radioactive substance as a tracer which combines almost exclusively with the liquid phase rather than the gaseous phase. Two separate injectivity profiles are thereby obtained, one describing the injectivity of the gaseous phase of the steam and the other describing the injectivity of the liquid phase of the steam, both within the same measured interval and the formation of interest.

Referring to the drawing, a well or bore hole 10 is shown as traversing several subsurface formations including the formation 12 for which it is desired to make a steam injection profile. The upper portion of the well is shown as being provided with a casing 14 having a closed casing head at 16. A string of tubing 18 passes through the casing head 16 and downwardly through the well to a point below the formation 12. At the surface a pump 20 is connected to the casing head through a meter or meters 22 and is adapted to pump a stream of fluid 24 downwardly into the well through the space between the casing 14 and the tubing 18. A small amount of one radioactive substance which combines almost exclusively with only one of the two phases contained within the fluid is added to the fluid 24 by means not shown, preferably before the fluid is taken into the pump 20. Another pump 26 is shown as connected to another meter or meters 28 to the upper end of the tubing and is adapted to pump nonradioactive fluid 30 downwardly through the tubing. The nonradioactive fluid passes out of the bottom end of the tubing and upwardly around the tubing until it meets the radioactive fluid 24 at the interface 32. It will be seen that, if the pumps 20 and 26 are adjusted to change their rates of pumping while the total amount of steam pumped remains constant, the interface 32 will be caused to move up or down 33 in the hole depending upon the two pumping rates.

Shown as suspended within the tubing 18 is a radioactivity logging instrument 34 containing a detector of gamma rays the output of which is conducted upwardly through the suspended cable 36. This cable passes over a suitable cable measuring device 38 which continuously indicates the depth of the instrument 34 in the hole and then to a suitable amplifier 40 and a recorder 42. When the instrument 34 is lowered down into the tubing it will respond to the radioactivity of the steam until it passes the interface 32 when the detector signal will suddenly decrease.

A record of the output of the detector is made continuously by the recorder and is correlated with the depth of the detector in the hole as measured by the device 38. Thus, by passing the detector 34 through the hole and correlating the points in the record from the radioactivity recorder 42 at which the detector passes from the radioactive fluid with the depth in the hole at which those points are registered, accurate measurements are made of the depth of the interface 32.

Selection of the particular radioactive substances to be used as tracers for each phase will of course depend on the particular two phase system to be examined. In a steam two phase system one effective radioactive tracer for the liquid phase is tritiated water comprising an $H_2O$ molecule with one of the hydrogen atoms being replaced by a tritium atom. This is a particularly effective tracer material for the liquid water phase inasmuch as the tritiated water molecule is slightly denser than a normal $H_2O$ molecule and, as a consequence, will tend to stay in the liquid phase rather than freely changing between the liquid and gas states as would a normal $H_2O$ molecule. However the effectiveness of tritium as a tracer is limited in wells where the tubing in the interval of interest is made from steel. This limitation could be circumvented by the use of non-ferrous tubing in the interval of interest. Other preferred liquid phase tracers are sodium iodide and sodium irridium chloride. Suitable radioactive tracers for the gaseous phase in the steam could include tritiated hydrogen gas, Krypton 85, radioactive ethyl iodide, radioactive methyliodide or any number of other radioactive gaseous isotopes which have relatively short half lives on the order of ten days or less. Application of other radioactive isotopes to different two phase fluid systems such as liquid water and air or liquid hydrocarbon and $CO_2$ is well within the expertise of one skilled in the art.

Reference is now made to the following Example to more particularly describe the practice of this invention in a steam injection well.

EXAMPLE I

The surveyed well has casing in the hole to a depth of 1300 feet which is perforated in the zone of interest from 1200 to 1240 feet with the tubing string extending below the zone of interest. The appropriate pumping and metering equipment has been placed around the well. Sodium iodide has been selected as the radioactive substance for the tracer for the liquid water phase and ethyl iodide has been selected as the radioactive tracer for the gaseous phase of the steam. The steam will be injected at 500 pounds per square inch (psi) gauge pressure at 70 percent quality (70 percent water vapor, 30 percent water liquid by mass).

The injectivity profile survey is conducted for the liquid water phase first with the sodium iodide being introduced into the steam which is injected into the annulus. It is quickly ascertained that a total fluid injection rate of 1000 barrels per day, with 0 barrels per day into the annulus and 1000 barrels per day of steam into the tubing will produce a stable interface at the top of the inverval of interest at 1200 feet. From this point it is decided to increase the injection rate into the annulus by 200 barrel per day increments while decreasing the injection rate into the tubing by a corresponding amount. After each such adjustment, the gamma ray tool is utilized to make a measurement of the depth of the new interface. The results of the injectivity profile survey for the liquid phase of steam are reported in Table I. Note that the total rate of liquid phase injected is 300 barrels per day (1000 bpd of 70 percent quality steam = 300 bpd liquid phase and 700 bpd vapor phase). A graphical representation of the liquid phase flow rate per foot as a function of the depth in the well is shown as the solid curve in FIG. 2.

TABLE I

| Depth to Interface | Liquid Phase Injection Rate Into Annulus (BPD) | Liquid Phase Injection Rate Into Tubing (BPD) | Interval Between Interfaces (ft) | Flowrate Into Interval (BPD/ft) |
|---|---|---|---|---|
| 1200 | 0 | 300 | | |
| | | | 25 | 2.4 |
| 1225 | 60 | 240 | | |
| | | | 5 | 12 |
| 1230 | 120 | 180 | | |
| | | | 3 | 20 |
| 1233 | 180 | 120 | | |
| | | | 4 | 15 |
| 1237 | 240 | 60 | | |
| | | | 3 | 20 |
| 1240 | 300 | 0 | | |

Data from this phase of the survey indicates then that the liquid water phase of the steam is entering predominantly into the bottom fifteen feet of the 40 foot interval as can be seen from the liquid phase curve in FIG. 2.

The gas phase measurements are now initiated with the radioactive tracer substance being changed over to ethyl iodide to serve as a marker for the gas phase of the steam. The interface is again stabilized at the 1200 foot level with injection rates of 0 barrels of steam per day into the annulus and 1000 barrels of steam (700 vapor) per day into the tubing. The injection rates are again changed at approximately 200 barrel per day increments while maintaining the total steam injection rate constant at 1000 barrels per day. The results of the injectivity measurements for the gas phase of the steam are reported in Table II; the corresponding graph is shown as a dashed curve in FIG. 2, depicting the vapor phase flow rate per foot as a function of the depth in the well.

TABLE II

| Depth to Interface | Vapor Phase Injection Rate Into Annulus (BPD) | Vapor Phase Injection Rate Into Tubing (BPD) | Interval Between Interfaces (ft) | Flowrate Into Interval (BPD/ft) |
|---|---|---|---|---|
| 1200 | 0 | 700 | | |
| | | | 5 | 28 |
| 1205 | 140 | 560 | | |
| | | | 5 | 28 |
| 1210 | 280 | 420 | | |
| | | | 5 | 28 |
| 1215 | 420 | 280 | | |
| | | | 10 | 14 |
| 1225 | 560 | 140 | | |
| | | | 15 | 9.33 |
| 1240 | 700 | 0 | | |

The results of the injectivity profile for the gas phase of the steam show that the majority of the gaseous phase is entering the top 15 feet of the total injection interval.

Since both the steam entering the annulus and the steam entering the tubing contain the same proportions of liquid and gaseous phases and further since the pressure and quality of the steam is known, it is also possible, using readily available steam tables, to calculate a total injected heat profile over the entire interval from the injectivity data produced by the practice of this invention. A heat profile over the interval of interest has been calculated from the preceding data, and the results are given in Table III. The rate of heat injection is graphed as a function of the depth of the well in FIG. 3. Such information would be exceedingly useful to one studying the effects of the steam injection program.

TABLE III

| Depth Interval | Liquid Phase Mass Flow Rate Per Foot (BPD/ft.) | Vapor Phase Mass Flow Rate Per Foot (BPD/ft.) | Steam Quality[1] | Injected Heat Per Foot (mm BTU/hr/ft) |
|---|---|---|---|---|
| 1200–1205 | 2.4 | 28 | .921 | .508 |
| 1205–1210 | 2.4 | 28 | .921 | .508 |
| 1210–1215 | 2.4 | 28 | .921 | .508 |
| 1215–1225 | 2.4 | 14 | .854 | .262 |
| 1225–1230 | 12 | 9.33 | .437 | .242 |
| 1230–1233 | 20 | 9.33 | .318 | .295 |
| 1233–1237 | 15 | 9.33 | .383 | .262 |
| 1237–1240 | 20 | 9.33 | .318 | .295 |

[1]Where:

$$\text{steam quality} = \frac{\text{Vapor Phase Mass Flow Rate/Foot}}{\text{Liquid Phase Mass Flow Rate/Foot} + \text{Vapor Phase Mass Flow Rate/Foot}}$$

The above example has been presented for the purpose of illustration and should not be considered as limitative. Obviously, many other modifications and variations of the invention as hereinbefore set forth are possible and may be made without departing from the spirit and scope thereof, and only such limitations should be imposed as indicated in the following claims.

I claim:

1. A method of making a permeability log of a subsurface formation traversed by a bore hole which comprises:
   (a) injecting a two phase fluid into the bore hole above said formation, said two phase fluid containing an effective amount of one radioactive substance which combines almost exclusively with only one phase of the injected two phase fluid;
   (b) simultaneously injecting a similar two phase fluid which does not contain the radioactive substance into the bore hole below the formation;
   (c) establishing a stable interface between the two fluids;
   (d) determining the depth in the hole of said interface by measuring the radioactivity of the fluids throughout that portion of the hole being examined;
   (e) then varying the ratio of the rates at which the two fluids are injected into the hole while maintaining the sum of the two rates as nearly constant as possible so as to cause said interface to move along the walls of the bore hole to another depth;
   (f) determining the depth of the interface produced by the change in injection rates in step (e) by the method of step (d);
   (g) repeating steps (e) and (f) until a series of depth and injection rated measurements at the various interfaces sufficient to adequately describe the formation is obtained for one phase of the injected two phase fluid; and
   (h) repeating steps (a) through (g) with a second radioactive substance that combines almost exclusively with the other phase of the two phase fluid.

2. The method of claim 1 wherein the two phase fluid is a steam which contains both water vapor and water liquid.

3. The method of claim 1 wherein the two phase fluid comprises air and water.

4. The method of claim 1 wherein the two phase fluid comprises carbon dioxide and a liquid hydrocarbon.

5. The method of claim 1 wherein the two phase fluid comprises carbon dioxide and liquid water.

6. A method of making a permeability log of a subsurface formation traversed by a bore hole containing a tubing string extending down below said formation which comprises:
   (a) injecting a two phase fluid into the annular space between the tubing and the walls of the hole, said two phase liquid containing an effective amount of one radioactive substance which combines almost exclusively with only one phase of the injected two phase fluid;
   (b) simultaneously injecting a similar two phase fluid which does not contain the radioactive substance into the bore hole below the formation through the tubing string;
   (c) establishing a stable interface between the two fluids;
   (d) determining the depth in the hole of said interface by measuring the radioactivity of the fluids throughout that portion of the hole being examined;
   (e) then varying the ratio of the rates at which the two fluids are injected into the hole while maintaining the sum of the two rates as nearly constant as possible so as to cause said interface to move along the walls of the bore hole to another depth;
   (f) determining the depth of the interface produced by the change in injection rates in step (e) by the method of step (d);
   (g) repeating steps (e) and (f) until a series of depth and injection rate measurements at the various interfaces sufficient to adequately describe the formation is obtained for one phase of the injected two phase fluid; and
   (h) repeating steps (a) through (g) with a second radioactive substance that combines almost exclusively with the other phase of the two phase fluid.

7. The method of claim 6 wherein the injection rates are adjusted first to position the interface substantially opposite the bottom of the formation, then are adjusted by increments to move the interface upwardly along the formation walls, the depth of the interface being determined after each increment.

8. The method of claim 6 wherein the two phase fluid is steam which contains both water vapor and water liquid.

9. The method of claim 6 wherein the two phase fluid comprises air and water.

10. The method of claim 6 wherein the two phase fluid comprises carbon dioxide and a liquid hydrocarbon.

11. The method of claim 6 wherein the two phase fluid comprises carbon dioxide and liquid water.

* * * * *

UNITED STATES PATENT AND TRADEMARK OFFICE

CERTIFICATE OF CORRECTION

PATENT NO. : 4,228,855

DATED : October 21, 1980

INVENTOR(S) : Alvin J. Sustek, Jr.; Terry L. Frazier, and Gregory Daryl

It is certified that error appears in the above-identified patent and that said Letters Patent are hereby corrected as shown below:

Page 1, the inventors are listed incorrectly. It should read as follows:

Inventors: Alvin J. Sustek, Jr.; Terry L. Frazier, both of Houston; Gregory Daryl Frazier, Woodlands, all of Tex.

Signed and Sealed this

*Tenth* Day of *March 1981*

[SEAL]

*Attest:*

RENE D. TEGTMEYER

*Attesting Officer* *Acting Commissioner of Patents and Trademarks*